US005547560A

United States Patent [19]

Le Guyader

[11] Patent Number: 5,547,560

[45] Date of Patent: Aug. 20, 1996

[54] CONSUMABLE ANODE FOR CATHODIC PROTECTION, MADE OF ALUMINUM-BASED ALLOY

[75] Inventor: Hervé Le Guyader, Tourlaville, France

[73] Assignee: Etat Francais represented by the Delegue General Pour L'Armement, Armees, France

[21] Appl. No.: 331,119

[22] Filed: Oct. 28, 1994

[30] Foreign Application Priority Data

Oct. 29, 1993 [FR] France ..... 93.12916

[51] Int. Cl.[6] ..... C23F 13/00

[52] U.S. Cl. ..... 205/732; 205/730; 420/528

[58] Field of Search ..... 204/147, 148, 204/196, 197; 420/528; 205/730, 732

[56] References Cited

U.S. PATENT DOCUMENTS

| | | | |
|---|---|---|---|
| 2,930,568 | 3/1960 | Rader | 204/197 |
| 3,240,688 | 3/1966 | Pryor et al. | 204/197 |
| 3,337,333 | 8/1967 | Reding et al. | 204/197 |
| 3,343,948 | 9/1967 | Raclot | 204/197 |
| 3,379,636 | 4/1968 | Reding et al. | 204/197 |
| 3,513,082 | 5/1970 | Beer et al. | 204/197 |
| 3,721,618 | 3/1973 | Reding et al. | 204/197 |
| 3,870,615 | 3/1975 | Wilson et al. | 204/197 |
| 4,098,606 | 7/1978 | Despic et al. | 204/148 |
| 4,240,829 | 12/1980 | Lukin et al. | 204/197 |
| 5,006,214 | 4/1991 | Burchnell et al. | 204/197 |

FOREIGN PATENT DOCUMENTS

| | | |
|---|---|---|
| 667337 | 1/1966 | Belgium . |
| 2301600 | 9/1976 | France . |
| 2377455 | 8/1978 | France . |
| 2449730 | 9/1980 | France . |
| 2616806 | 12/1988 | France . |
| 2150102 | 4/1972 | Germany . |
| 56-119785 | 9/1981 | Japan . |
| 1358899 | 7/1974 | United Kingdom . |

OTHER PUBLICATIONS

ASM Specialty Handbook, Aluminum and Aluminum Alloys, p. 639, Dec. 1993.

*Primary Examiner*—T. Tung
*Attorney, Agent, or Firm*—Oliff & Berridge

[57] ABSTRACT

A consumable anode for cathodic protection of steels and alloys susceptible to corrosion in seawater operating in an electrochemical potential range in seawater of −870 mV to −700 mV based on the potential of a saturated calomel electrode, is composed of an aluminum-based alloy having a gallium percentage of 0.03 to 0.20% and/or a cadmium percentage of 0.03 to 0.20%.

12 Claims, 1 Drawing Sheet

CONSUMABLE ANODE FOR CATHODIC PROTECTION, MADE OF ALUMINUM-BASED ALLOY

BACKGROUND OF THE INVENTION

The present invention relates to a reactive or consumable anode made of an aluminum-based alloy for cathodic protection in seawater of iron, steels, and alloys susceptible to corrosion and embrittlement by hydrogen.

It is usually considered that corrosion is negligible with an iron concentration less than or equal to $10^{-6}$ mole/liter, i.e. an embrittlement potential less than or equal to −850 mV referred to the potential of a saturated calomel electrode (SCE). The potential range encountered for cathodic protection of ships in seawater and of offshore structures is between −850 mV and −1100 mV.

At these potentials, the use of known reactive protective anodes fully protects steel against generalized corrosion and corrosion by galvanic coupling which may occur in seawater. However, reduction of deaerated water causes hydrogen to be released at the surface of the steel thus protected, which may bring about additional corrosion. It is known that hydrogen embrittles certain steels with a high yield strength and their welds as well as titanium alloys, and that susceptibility to corrosion under stress due to hydrogen decreases sharply at potentials above −800 mV.

The performances and electrochemical characteristics of such an anode, which are principally the electrochemical potential at zero current, the current flowing per unit area at a given potential, the electrochemical efficiency, and the mass energy or quantity of current flowing per unit weight of dissolved anode in ampere-hours per kilogram, are determined by the alloy from which the reactive anode is made.

Aluminum and zinc alloys for making anodes protecting a metal structure in contact with an aggressive electrolytic medium are already known. Patent FR 2,377,455 describes compositions of alloys having aluminum or zinc percentages by weight of 8 to 40%, the remainder being zinc or aluminum. Aluminum-based alloys with added zinc have iron, silicon, and copper impurities and must have a purity of at least 99.80%. Stabilizers of the electrode potential such as mercury, indium, manganese, and titanium can be added.

Patent FR 2,449,730 discloses an aluminum-based protective alloy composition containing gallium in the proportions of 0.005 to 3.5 wt. % and magnesium in the proportions of 0.1 to 1 wt. %, and having known electrochemical properties.

An aluminum alloy for offshore protection containing 0.04 wt. % mercury and 2 to 4.5 wt. % zinc, with iron, silicon, and titanium impurities and a high mass energy of 2790 ampere-hours per kilogram is also known. This alloy is effective at a potential less than −1045 mV/SCE, with a current density of 1.5 mA/cm$^2$.

An offshore protection aluminum alloy having 0.02 wt. % indium and 5 wt. % zinc, with less mass energy than the previous alloy, is also known.

Patent FR 2,616,806 describes an aluminum-based alloy composition containing indium weight percentages of 0.005 to 0.05, zinc of 0.05 to 8, gallium of 0.003 to 0.05, manganese of 0.01 to 0.3, iron of 0.03 to 0.3, and magnesium of 0.02 to 2 and silicon of 0.03 to 0.4.

These various known alloy compositions are effective against generalized corrosion and corrosion by galvanic coupling in the relatively low electronegative potential range of −1000 to −1100 mV but do not protect from corrosion under stress by hydrogen embrittlement, which is avoidable only at potentials greater than −800 mV. Steels are thus not fully protected from corrosion at electrode potentials less than −860 mV/SCE by reactive anodes having known aluminum-based alloy compositions.

SUMMARY OF THE INVENTION

A goal of the invention is hence to propose a reactive or consumable anode for cathodic protection, made of a certain aluminum-based alloy composition and able to operate in a limited potential range of −870 mV to −700 mV referred to the potential of a saturated calomel electrode, which corresponds to the range in which hydrogen embrittlement of steels and alloys with high yield strengths is low.

The reactive anodes according to the invention provide proper protection against generalized corrosion and corrosion by galvanic coupling of moderately alloyed steels, particularly with the element nickel, in the cathodic potential range of −870 mV to −700 mV/SCE, which is different from the usual range of −850 mV to −1100 mV/SCE. In this protection range, the kinetics of hydrogen release are considerably reduced.

Hence, the subject of the invention is a reactive anode for cathodic protection in seawater of steels and alloys against corrosion in seawater and hydrogen embrittlement, characterized by being composed of an aluminum-based alloy molded on a steel support for mounting and electrical conduction, whereby the aluminum-based alloy has the following composition indicated in weight percent:

| | |
|---|---|
| Gallium or Cadmium | 0.03 to 0.20.% |
| Manganese | 0.15% max |
| Iron | 0.15% max |
| Silicon | 0.15% max |
| Zinc | 0.15% max |
| Indium | 0.007% max |
| Mercury | 0.007% max |
| Magnesium | 0.10% max |
| Titanium | 0.02% max |
| Other | 0.01% max |
| Aluminum | balance |

and operating in an electrochemical potential range in seawater of −870 mV to −700 mV referred to the potential of a saturated calomel electrode.

The percentage by weight of gallium is preferably equal to 0.1%.

In another embodiment of the invention, the aluminum-based alloy composition includes cadmium in a range of values from 0.03 to 0.20 wt. %, replacing the gallium.

The percentage by weight of the cadmium is preferably equal to 0.1%.

In another embodiment of the invention, the aluminum-based alloy composition includes cadmium in a range of values from 0.03 to 0.20 wt. % in addition to the alloy composition already containing gallium in the range of 0.03 to 0.20 wt. %.

The cathodic protection anode according to the invention can include at least one steel spacing plate to regulate the potential of the low-current anode.

The cathodic protection anode is characterized by the ratio between the area of the aluminum-based alloy part and the area of the spacing plate or plates being less than 5, preferably equal to 1.5.

Other characteristics and advantages of the invention will emerge more clearly from the description hereinbelow with reference to the single drawing attached and the following examples.

DESCRIPTION OF PREFERRED EMBODIMENTS

Figure 1:
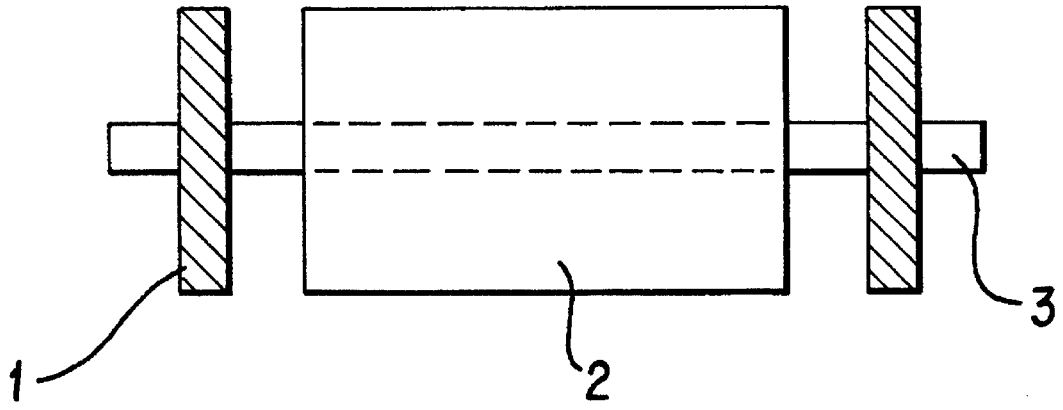
FIG. 1 is a cross-sectional view of a reaction anode according to the invention.

The reactive cathodic protection anode comprises a cylindrical part 2 made of an aluminum-based alloy having the electrochemical properties desired for protection, cast on a core 3 or mounting and electrical conduction support, and one or more steel spacing plates 1. The plates are used to regulate the potential of the low-current anode because the aluminum alloys have an unstable potential at low current.

The aluminum alloy according to the invention has a gallium percentage which can range from 0.03 to 0.20 wt. % and is preferably equal to 0.1%. The contents of manganese, iron, zinc, and silicon are a maximum of 0.15 wt. %, those of indium and mercury a maximum of 0.007 wt. %, that of magnesium a maximum of 0.10 wt. %, and that of titanium a maximum of 0.02 wt. %. The basic aluminum has a purity of at least 99.08 wt. %.

Activation of this alloy is due to the gallium, according to a mechanism of anodic dissolution of gallium in a solid solution, followed by precipitation of the finely divided metal at the surface of the aluminum. The gallium, while favoring uniform activation of the anode surface, assists in maintaining a constant anode potential.

Addition of titanium in the form of Tiβ allows the grain size to be kept within the desired range.

Another alloy composition according to the invention has a cadmium content of 0.03 wt. % to 0.20 wt. %, preferably 0.10%, replacing the gallium or in addition to the composition already containing gallium.

The area ratio between the aluminum alloy part 2 and spacing plate or plates 1 is less than 5, preferably 1.5 for optimum protection.

EXAMPLE 1

A cast alloy was tested in an anode according to the invention having the following percentages by weight:

| | |
|---|---|
| Gallium | 0.102% |
| Iron | 0.046% |
| Silicon | 0.035% |
| Zinc | 0.065% |
| Titanium | 0.02% max |
| Manganese | <0.15% |
| Other | <0.01% |
| Aluminum | balance. |

The resting potential in seawater is −850 mV±50 mV/SCE.

The anodic potential measured with a current density of 30 mA/dm$^2$ is −800 mV/SCE.

The mass energy is 1937 AH/kg.

Tests have been conducted according to a NACE (National Association of Corrosion Engineers) specification involving 15 days exposure to seawater of specimens with a diameter of 38 mm, height 16.8 mm, active surface area 0.4095 dm$^2$, and current of 25.4 mA. The average potential is −804 mV/SCE and the electrochemical efficiency 80%.

Tests conducted according to a DNV (Der Norske Veritas) specification involving four days exposure to seawater of specimens with diameter 38 mm, height 16.8 mm, active surface area 0.4095 dm$^2$, and current ranging between 16.4 mA and 163.8 mA shows an average potential of −770 mV and electrochemical efficiency of 70%.

The corrosion rates, both generalized and under galvanic coupling in natural seawater at room temperature of two types of steel protected by reactive anodes according to the invention, were measured: a high-yield-strength steel moderately alloyed with Ni 5% type nickel and a type E28 construction steel. No corrosion was found at a potential of −800 mV/SCE for these two types of steel.

The corrosion rate is on the order of 1 to 10 micrometers/year at −700 mV/SCE for the type Ni 5% high-yield-strength steel; it is of the same order of magnitude at a potential of −760 mV/SCE for type E28 construction steel. On the other hand, corrosion becomes significant at a potential higher than −600 mV/SCE. Corrosion by hydrogen under stress was insignificant in the potential range in question. The kinetics of hydrogen release were lower by a factor of 10 between −800 mV and −1020 mV and by a factor of 20 at −1060 mV.

EXAMPLE 2

A cast alloy was tested in an anode according to the invention having the following percentages by weight:

| | |
|---|---|
| Cadmium | 0.089% |
| Iron | 0.021% |
| Silicon | 0.025% |
| Zinc | 0.007% |
| Manganese | <0.15% |
| Titanium | <0.02% |
| Other | <0.01% |
| Aluminum | balance. |

The resting potential in seawater was −850 mV±50 mV/SCE.

The anodic potential measured at 2 mA/cm$^2$ was −730 mV/SCS.

The mass energy was 2384 AH/kg and the electrochemical efficiency 80%.

Corrosion rate measurements made with this type of reactive anode under the same conditions as above gave results similar to those obtained with reactive anodes including gallium.

What I claim is:

1. Reactive anode for cathodic protection in seawater of iron, steels and alloys against corrosion in seawater and hydrogen embrittlement wherein said anode is composed of an aluminum-based alloy upon an electrically conducting mounting support, wherein the aluminum-based alloy has the following composition indicated in weight percent:

Gallium and/or Cadmium in an amount of from 0.03 to 0.20%

Manganese in an amount of from greater than zero to 0.15% max

Iron in an amount of from greater than zero to 0.15% max

Silicon in an amount of from greater than zero to 0.15% max

Zinc in an amount of from greater than zero to 0.15% max

Indium in an amount of from greater than zero to 0.007% max

Mercury in an amount of from greater than zero to 0.007% max

Magnesium in an amount of from greater than zero to 0.10% max

Titanium in an amount of from greater than zero to 0.02% max

Other in an amount of from greater than zero to 0.01% max

Aluminum balance, said anode operating in an electrochemical potential range in seawater of −870 mV to −700 mV based on the potential of a saturated calomel electrode.

2. Reactive anode for cathodic protection in seawater of iron, steels and alloys against corrosion in seawater and hydrogen embrittlement, according to claim 1, wherein said anode is composed of an aluminum-based alloy having 10% gallium.

3. Reactive anode for cathodic protection in seawater of iron, steels and alloys against corrosion in seawater and hydrogen embrittlement, according to claim 1, wherein said anode has at least one steel spacing plate for regulating the potential of said anode.

4. Reactive anode for cathodic protection in seawater of iron, steels and alloys against corrosion in seawater and hydrogen embrittlement, according to claim 3, wherein the ratio between the area of the aluminum-based alloy and the area or areas of the one or more spacing plates is less than 5.

5. Reactive anode for cathodic protection in seawater of iron, steels and alloys against corrosion in seawater and hydrogen embrittlement, according to claim 4, wherein the ratio between the area of the aluminum-based alloy and the area or areas of the one or more spacing plates is to 1.5.

6. Reactive anode according to claim 1, wherein said electrically conducting mounting support is steel.

7. Reactive anode according to claim 1, wherein said aluminum-based alloy is cast or molded upon said support.

8. Reactive anode for cathodic protection in seawater of iron, steels and alloys against corrosion in seawater and hydrogen embrittlement, wherein said anode is comprised of an aluminum-based alloy upon an electrically conducting mounting support, the aluminum-based alloy having the following composition given in weight percent:

Gallium in an amount of from 0.03 to 0.20%

Cadmium in an amount of from 0.03 to 0.20%

Manganese in an amount of from greater than zero to 0.15% max

Iron in an amount of from greater than zero to 0.15% max

Silicon in an amount of from greater than zero to 0.15% max

Zinc in an amount of from greater than zero to 0.15% max

Indium in an amount of from greater than zero to 0.007% max

Mercury in an amount of from greater than zero to 0.007% max

Magnesium in an amount of from greater than zero to 0.10% max

Titanium in an amount of from greater than zero to 0.02% max

Other in an amount of from greater than zero to 0.01% max

Aluminum balance, said anode operating in an electrochemical potential range in seawater of −870 mV to −700 mV based on the potential of a saturated calomel electrode.

9. Reactive anode for cathodic protection in seawater of iron, steels and alloys against corrosion in seawater and hydrogen embrittlement, according to claim 2, wherein said anode is composed of an aluminum-based alloy having 10% cadmium.

10. Reactive anode according to claim 8, wherein said electrically conducting mounting support is steel.

11. Reactive anode according to claim 6, wherein said aluminum-based alloy is cast or molded upon said support.

12. A method of protecting iron, steels and alloys against corrosion in sea water and hydrogen embrittlement comprising providing a reactive anode of an aluminum-based alloy upon an electrically conducting mounting support wherein the aluminum-based alloy has the following composition indicated in weight percent:

Gallium and/or Cadmium in an amount of from 0.03 to 0.20%

Manganese in an amount of from greater than zero to 0.15% max

Iron in an amount of from greater than zero to 0.15% max

Silicon in an amount of from greater than zero to 0.15% max

Zinc in an amount of from greater than zero to 0.15% max

Indium in an amount of from greater than zero to 0.007% max

Mercury in an amount of from greater than zero to 0.007% max

Magnesium in an amount of from greater than zero to 0.10% max

Titanium in an amount of from greater than zero to 0.02% max

Other in an amount of from greater than zero to 0.01% max

Aluminum balance, said anode operating in an electrochemical potential range in seawater of −870 mV to −700 mV based on the potential of a saturated calomel electrode.

* * * * *

UNITED STATES PATENT AND TRADEMARK OFFICE

CERTIFICATE OF CORRECTION

PATENT NO. : 5,547,560

DATED : August 20, 1996

INVENTOR(S) : Herve LE GUYADER

It is certified that error appears in the above-indentified patent and that said Letters Patent is hereby corrected as shown below:

Claim 2, column 5, line 17, change "10%" to --0.10%--.

Claim 9, column 6, line 18, change "10%" to --0.10%--.

Signed and Sealed this

Eighth Day of July, 1997

Bruce Lehman

*Attest:*

BRUCE LEHMAN

*Attesting Officer*

*Commissioner of Patents and Trademarks*